US006550393B2

(12) United States Patent
Stengel

(10) Patent No.: US 6,550,393 B2
(45) Date of Patent: Apr. 22, 2003

(54) WOODEN RAIL FOR A RIDE AS WELL AS A METHOD FOR FABRICATING AND MOUNTING SUCH A WOODEN RAIL

(76) Inventor: Werner Stengel, Minorstr. 19, 81477 München (DE)

( * ) Notice: Subject to any disclaimer, the term of this patent is extended or adjusted under 35 U.S.C. 154(b) by 0 days.

(21) Appl. No.: 09/732,495

(22) Filed: Dec. 7, 2000

(65) Prior Publication Data

US 2001/0003261 A1 Jun. 14, 2001

(30) Foreign Application Priority Data

Dec. 7, 1999 (DE) ..... 199 58 923

(51) Int. Cl.[7] ..... E01B 25/14

(52) U.S. Cl. ..... 104/124; 104/126; 104/53; 238/10 F

(58) Field of Search ..... 104/124, 125, 104/126, 53; 238/10 R, 10 F, 131, 121, 122, 156, 14.14

(56) References Cited

U.S. PATENT DOCUMENTS

| | | | | | |
|---|---|---|---|---|---|
| 1,431,567 | A | * | 10/1922 | Church | 105/4.3 |
| 1,454,760 | A | * | 5/1923 | Neary | 104/246 |
| 1,508,453 | A | * | 9/1924 | Hooper, Jr. | 104/125 |
| 1,621,337 | A | | 3/1927 | Schmeck | |
| 1,881,151 | A | * | 10/1932 | Traver | 104/53 |
| 3,895,138 | A | * | 7/1975 | Sewell et al. | 427/298 |
| 4,108,377 | A | * | 8/1978 | Potter | 238/84 |
| 4,269,875 | A | * | 5/1981 | Bechgaard et al. | 427/291 |
| 4,286,753 | A | * | 9/1981 | Lee | 238/37 |
| 4,505,987 | A | * | 3/1985 | Yamada et al. | 428/553 |
| 4,923,760 | A | * | 5/1990 | Adkins et al. | 428/541 |
| 4,960,137 | A | * | 10/1990 | Pott et al. | 144/349 |
| 5,832,692 | A | * | 11/1998 | Opferbeck et al. | 52/745.19 |

FOREIGN PATENT DOCUMENTS

DE 1 703 917 3/1972

OTHER PUBLICATIONS

Dering, Florian "Volksbelustigungen", Greno Verlagsgesellschaft, Nördlingen, 1986, pp. 119–127.

* cited by examiner

*Primary Examiner*—S. Joseph Morano
*Assistant Examiner*—Frantz F. Jules
(74) *Attorney, Agent, or Firm*—Renner, Otto, Boisselle & Sklar, LLP

(57) ABSTRACT

A wooden rail for a ride, in particular for a roller coaster, includes a number of layers of individual planks/boards, laminated veneer wood or presspahn wood, bonded with each other and milled to the precise rail form in accordance with a roller coaster design. In a method for the fabrication of such a wooden rail, the layers are bonded with each other to form an oversized wood package and, after hardening, the bonded wood package is given the precise rail form in accordance with the design of the ride by means of machining. Finally, in a method for mounting such a wooden rail on a rail support that is fixed to a trestle of the ride includes mounting finished rails having steel sheets, rail joints and connection elements to the rail support.

11 Claims, 17 Drawing Sheets

Section A-A

Section A-A

Section A-A

Radius Rv vertical to rail plane and twisting

Radius $R_h$ horizontal to rail plane and twisting

Section A-A

Section B-B

Section C-C

WOODEN RAIL FOR A RIDE AS WELL AS A METHOD FOR FABRICATING AND MOUNTING SUCH A WOODEN RAIL

FIELD OF THE INVENTION

The invention relates to a wooden rail for a ride, particularly for a roller coaster, as well as to a method for fabricating and mounting such a wooden rail.

BACKGROUND OF THE INVENTION

As explained in the book "Volksbelustigungen", written by Florian Dering, Greno Verlagsgesellschaft, Nördlingen, 1986, pp. 119–127, the first up-and-down rides, particularly roller coasters, were mere wooden constructions. Only the wheels and the chassis of the wagons and the elevator means were made of iron. The frame was made of spruce and pine wood, and the rails were made of multiple-bonded spruce wood, with the track surface being made of maple. The rims on both edges of the rail, which served to guide, i.e. the so-called "bands" (In German "Banden"), consisted of bonded planks and were bent in drying stoves to the desired shape of the rails.

However, due to the relatively slow driving speeds, the wooden rails at that time did not have lateral inclination, i.e. the planks were arranged in layers one over the other horizontally and parallel.

Over the course of time, these early wooden constructions were replaced by up-and-down rides or roller coasters made of steel, and in 1964 the Schwarzkopf Company of Munsterhausen/Swabian built the first roller coaster in the Federal Republic of Germany which was completely made of steel. The track constructions were of modular design and prefabricated, and were only put together to form the skeleton at the place of use, as can be deduced, for example, from DE-OS 17 03 917.

Today, most up-and-down rides or roller coasters are equipped with steel rails; in recent times, however, there is an increase in the number of wooden roller coasters with wooden rails being constructed. In addition, there are still some designs of wooden roller coasters and up-and-down rides having wooden rails, which, due to wear and tear, have to be replaced every four to seven years.

Wooden rails used for roller coasters or for general up-and-down rides are fabricated at the place where the up-and-down ride is to be erected, made of individual wooden layers, i.e. of planks, such as sawn timber at least 8 mm thick and less than 40 mm thick, or of boards, i.e. sawn timber at least 40 mm thick (see DIN 68 252). These two terms will be used interchangeably in the following description as the selection of a specific type of sawn timber depends on conditions which are of no further interest here.

The first plank/board is placed as the first layer onto the rail support provided at the trestle of the rail frame and vertically pre-bent, i.e. in vertical direction to the rail plane; a valley of the rail thus being pushed downwards or a hill of the rail being pushed upwards. Then, the second plank/board layer is placed onto the first layer in an offset manner, and both layers are then nailed together. Then, the third layer is placed, and so on, until the desired thickness is obtained.

Generally, wooden rails for roller coasters comprise approximately eight layers, although more or less layers can also be used.

Subsequently, rail connectors made of squared timber, extending at a right angle to the direction of the rails, are fixed to the prefabricated package of layers by means of screw bolts. These rail connectors function to maintain the track width of the two rails running parallel to one other; to distribute the loads from the guide wheels of the vehicle, running on the rails, to both rails; to stabilize the rails; and, if desired, to provide a catwalk for the service staff.

Afterwards, steel sheets for the running wheels and for the guide wheels of the vehicle are continuously fixed to the rail by means of screw bolts. Steel sheets for the counter wheels are also arranged at those points where the counter wheels engage.

Owing to the usual speeds encountered nowadays, each roller coaster rail, i.e. each wooden rail, is three-dimensionally curved in large regions, i.e. there are radii vertical to the rail plane and radii horizontal to the rail plane, and the lateral inclination $\beta$ of the rail may constantly change. This means that the right and the left rail of a pair of rails may be inherently twisted.

In the case of rails having horizontal radii in the rail plane, the two planks/boards at which the counter wheels may engage, are often placed differently than in the case of rails without horizontal radii.

Because the planks/boards run linearly, the rail package, comprising rails with horizontal radii, is constructed in oversize segments, and the radii on the inner side of the right and left rails are worked out by carpenters, i.e. usually by hand. This is arduous, awkward, and troublesome work, as the rails are assembled manually in situ after the trestles have been placed, and the carpenters are exposed to the wind and weather.

Owing to the carpenter's manual fabrication, the carpenters have many possibilities to deviate from the rail design. Consequently, the rails have large tolerances; in particular for the inner dimension of the rail between the steel sheets for the guide wheels and between the two rail supports from trestle to trestle. These tolerances result in rather rough rides being associated with wooden rides as compared to rides, for example, on roller coasters constructed of prefabricated steel rails.

Due to the layer-wise nailing and the subsequent bolting, the rails have only partial joint coverage and the individual layers at the joints between two subsequently following rails have no additional joint coverage, leading to the following disadvantage. While the vehicle runs past, the individual layers of planks/boards are subjected to relative displacements, which lead to loosening of nails and the formation of gaps between the individual layers, as the planks/boards are still inherently twisted. Accordingly, water may penetrate the rail causing early rotting of the wood. Furthermore, in winter the effects of frost, snow and condensation water also come into play.

The rails are deflected to a higher degree, as the individual layers are only mounted in partial composite. As there is only minor load distribution of the pressures from the running wheels over the relatively thin steel sheet, the uppermost layer is often subjected to pressure, perpendicular to the direction of the wood fiber, exceeding the admissible pressure load.

Experience shows that, owing to the above influences, wooden rails for up-and-down rides/roller coasters have to be completely replaced after a period of four to seven years.

SUMMARY OF THE INVENTION

It is an object of the invention to provide a wooden rail for an up-and-down ride, especially a roller coaster, which obviates the above-mentioned disadvantages. In particular, the wooden rail can be prefabricated industrially to the greatest possible extent, and then only needs to be mounted on the trestles.

This object is solved by the features set forth in claim 1 of the invention. Pertinent embodiments are defined by the appertaining sub-claims.

The advantages obtained by this aspect of the invention are based on construction of a rail from laminated wood board, laminated veneer wood or presspahn wood (particle board) in a wood glue construction method, wherein the board layers are arranged parallel to the rail plane, perpendicular to the rail plane, or, in a mixed construction partially parallel and partially perpendicular to the rail plane, and then are bonded, in particular glued, to each other. The rails, milled to the precise form, only need to be secured to the rail support on the trestle.

It is even possible to prefabricate pairs of rails including rail connectors and to transport them to the place where the ride is to be erected. For transport reasons, however, it is generally more advisable to only fabricate the individual rails, and to assemble them to pairs of rails at the site.

Such rails can be prefabricated at a precise accuracy of ±1 mm, which had not been possible heretofore, as they had to be made manually of individual layers by the carpenters at site. Thus, the quality of a roller coaster ride, employing such wooden rails, has been significantly improved.

Prefabrication of rails also reduces the time required for construction. In addition, such prefabrication is independent of the trestles, their mounting and of the current conditions prevailing at the site.

Prefabricated rails are stiffer (for the same cross section) than wooden rails produced by nailing, with the result that they deflect less; and fewer rail connectors, or absolutely none, are required. Alternatively, the rail cross section of a bonded, prefabricated wooden rail may be made smaller than that of a wooden rail produced by nailing together individual layers.

Due to its smooth surface, a bonded, prefabricated wooden rail looks better than a rail produced by nailing.

The package of prefabricated, bonded wood layers prevents any relative displacement of the individual layers of planks/boards towards each other, so that the load distribution can be defined precisely and does not change in the course of operation. Furthermore, the outer surfaces of this package are smooth and can be sealed without any problem, so that water cannot penetrate through open layers. Compared to nailed rails, the service life can thus at least be doubled, sometimes even tripled, which results in the valuable material "wood" being saved, and, simultaneously, in considerable cost savings.

Generally, the board layers are arranged parallel to the rail plane and then bonded with each other, as by gluing. It is, however, also possible to arrange the individual board layers perpendicular to the rail plane or mixed, i.e. partially perpendicular and partially parallel to the rail plane, e.g., alternating, and then bond them with each other.

For special applications, for example if special features are required for the outer surface of the wooden rail, layers of oversized rough wood bonded together and milled to the precise rail form can be regarded as a kind of core for a rail, acting as the gauge for any further side or cover layers that will be bonded to said core. The desired features may then be set, for example, by selection of appropriate types of wood for the side or cover layers, but also by the appropriate processing of such layers.

The service life is also additionally prolonged by applying a wood preservative to the individual layers before or after bonding, and/or to the milled and bonded layers.

It is advisable that a plank/board of hardwood be used for the uppermost layer to improve the pressure absorption perpendicular to the wood fiber at those places where the greatest wheel pressure occurs. Alternatively, for instance, the plank/board for the uppermost layer may be hardened by silicification. Both measures, which may also be used together under extreme conditions, result in a longer service life.

The fundamental difference between prior art wooden rails and the wooden rails according to the invention becomes evident in the following comparison: fabrication and mounting of wooden rails conventionally fabricated by carpenters for a standard roller coaster requires about 6 t of nails, to be worked with manually at site, whereas fabrication and mounting of the rails according to the invention makes nails superfluous.

According to another aspect of the invention, the drawbacks of the above-mentioned nail-method, used to fabricate wooden rails for rides, are avoided. In particular, it is intended to obtain an industrial fabrication, which avoids the drawbacks arising from the carpenter's work with wood packages at site.

This is achieved by the features of claim 7 according to the invention. Suitable embodiments are defined by the appertaining sub-claims.

Owing to the advantages obtained by this aspect of the invention, fabrication is simplified irrespective of the conditions prevailing at the place where the roller coaster is to be erected, the fabrication time for the wooden rails is shortened, and, finally, the accuracy of fabrication is increased to an extent that cannot be attained by carpenter's work.

According to a third aspect of the invention, a method for mounting a wooden rail for a ride is provided, which obviates the disadvantages of mounting performed rails by carpenters, hitherto usual, and which, in particular, considerably reduces the mounting time at site, i.e. at the place where the ride is to be erected.

This is realized by the features of claim 13.

The advantages obtained by this aspect of the invention are based on the fact that the prefabricated rails, already completely prepared for mounting, i.e. rails, which in a preferred case are already provided with steel rails, joint areas and rail connectors, are transported to the construction site, where they are mounted to the support base, which is generally done by screw-fastening. This results in a considerable reduction of the required mounting time at site and, thus, in the influences caused by wind and weather. Furthermore, owing to the prepared rail joints, the individual rails can be connected with each other much easier, faster and also more precisely.

BRIEF DESCRIPTION OF THE DRAWINGS

The invention will be explained in more detail by means of the following embodiments with reference to the appertaining diagrammatic drawings, in which.

DETAILED DESCRIPTION

Figure 1:
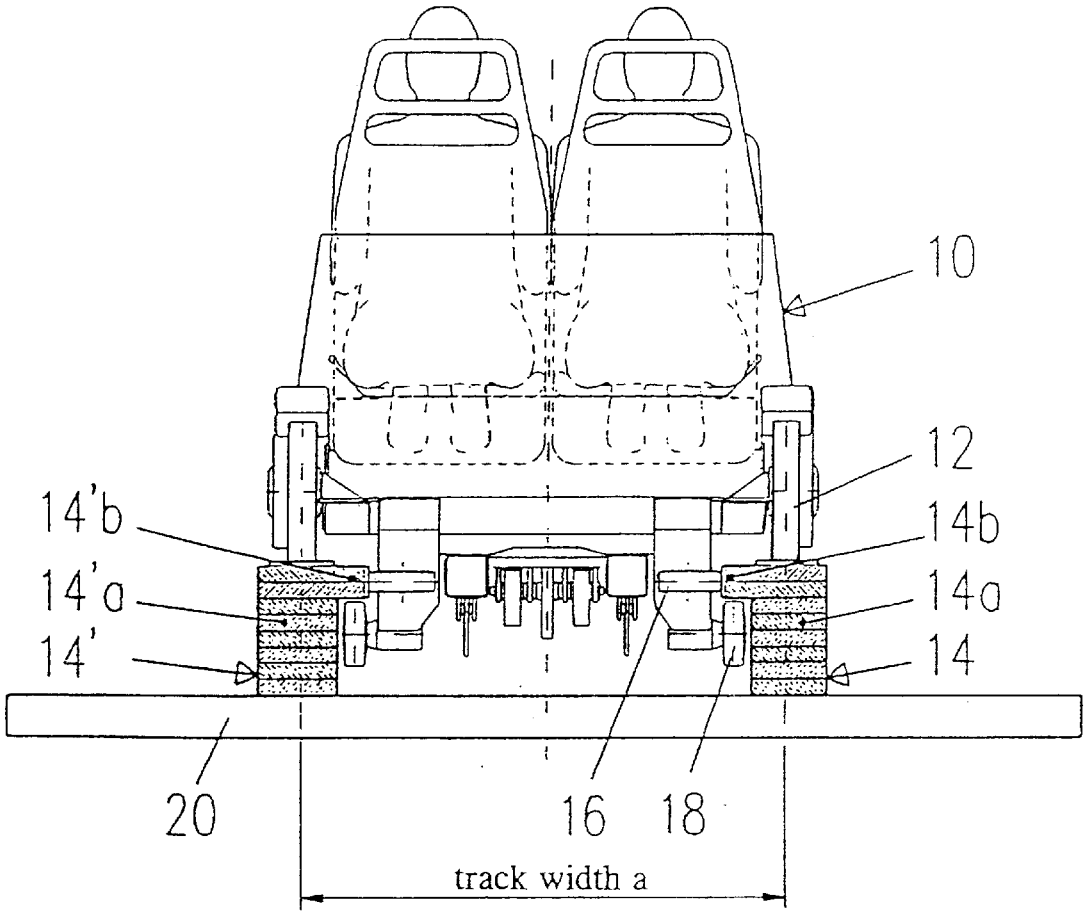
FIG. 1 is a vertical section through a wooden roller coaster rail with vehicle.

FIG. 1 shows a vertical section through a vehicle (truck or car) of a roller coaster, indicated by the reference numeral 10, with two passengers. Running wheels 12 of this vehicle 10 roll on a pair of rails 14, 14', i.e. a right rail 14 and a left rail 14'. The main body 14*a* of each rail 14, 14' is of rectangular cross section and has a projecting nose 14*b*, 14*b*' at its upper end, which serves to guide the vehicle 10 upon lifting loads. For this purpose, the vehicle 10 is provided with vertical counter wheels 18 rotating around a horizontal axis, in this representation without transversal rail inclination, and rolling along the lower surface of the nose 14*b*, 14*b*' upon lifting loads, and with guide wheels 16, horizontally arranged, rotatable around a vertical axis in the representation in accordance with FIG. 1, and roll to the left or right along the face of the nose 14*b*, 14*b*' (also see U.S. Pat. No. 1,621,337).

Both rails 14, 14' are mounted on a common lath rail connector 20, running at a right angle to the direction of movement. Such rail connectors 20 maintain the track width a between the two rails 14, 14'.

Figure 2:
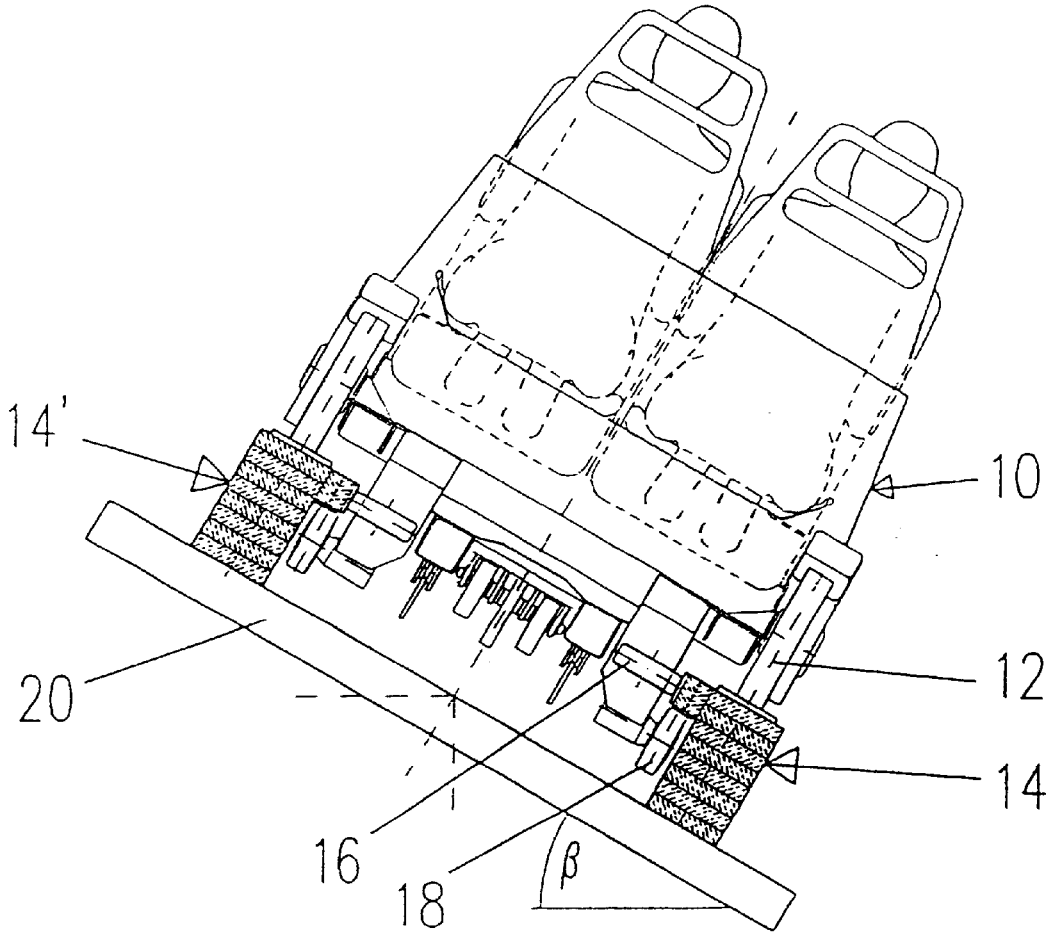
FIG. 2 shows a representation in accordance with FIG. 1, comprising rails having a transversal inclination β in the direction of movement.

FIG. 2 shows a view of a pair of rails 14, 14', corresponding to the representation shown in FIG. 1, having a transversal rail inclination β.

Both rails 14, 14' consist of a number of stacked layers of planks/boards, laminated veneer wood, plywood or presspahn wood (particle board) bonded, as by gluing, with each other and then milled to the form of the rail.

Figure 3:
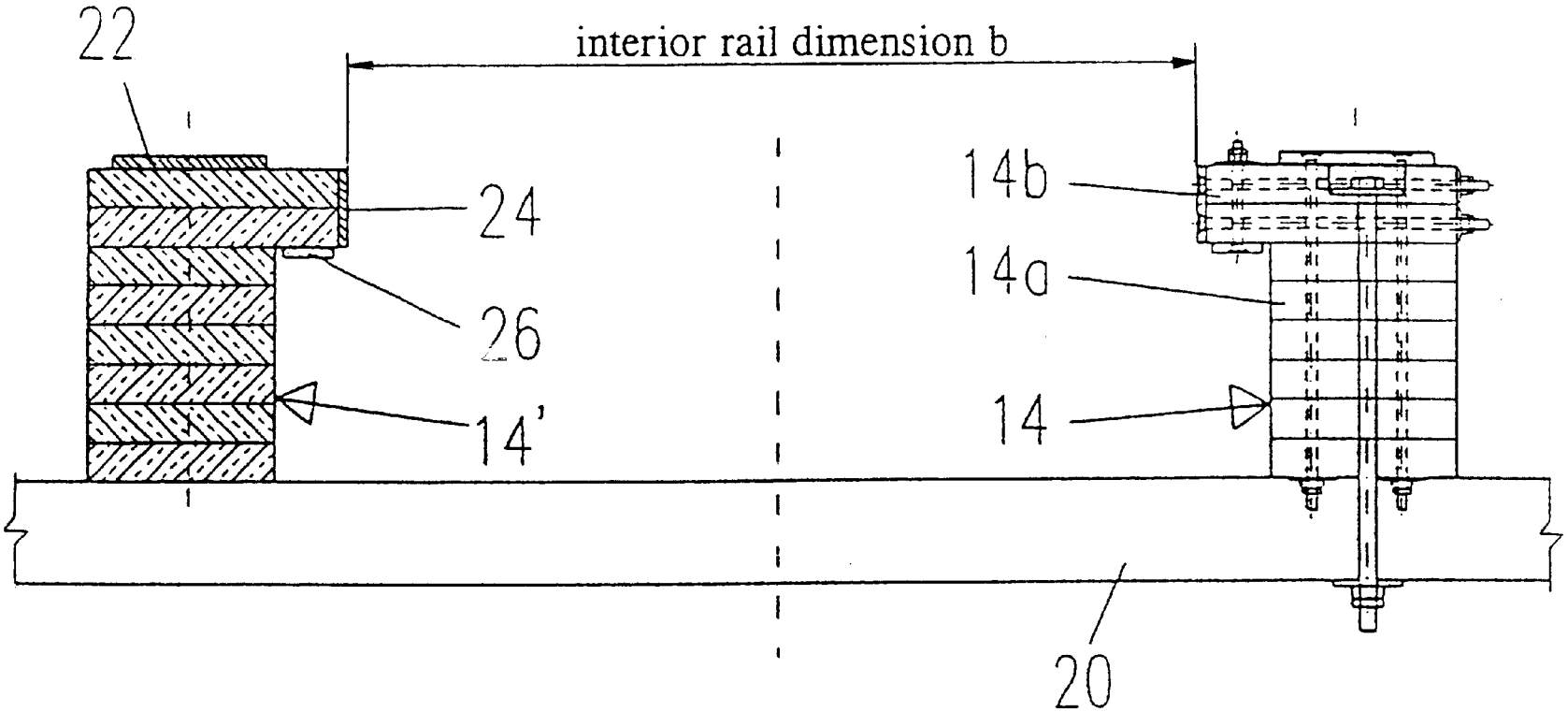
FIG. 3 is a vertical section through the pair of rails.

FIG. 3 shows the two rails 14, 14' with steel sheets being mounted thereto, on which the wheels 12, 16, 18 run, namely, a steel sheet 22 provided on the upper side of each rail 14, 14' to let the running wheels 12 of vehicle 10 roll, a steel sheet 24 provided at the front face of noses 14*b*, 14*b*' to let the guide wheels 16 roll, and a steel sheet 26 provided at the bottom side of noses 14*b*, 14*b*' to let the counter wheels 18 roll.

Steel sheets 22 and 24 extend over the entire length of the track on which vehicle 10 travels, whereas steel sheets 26 are only provided at those points where the counter wheels 18 engage. This can still be done at a later time if such engaging points for the counter wheels 18 become apparent upon operation.

Such a wooden rail is fabricated as follows.

Figure 4:
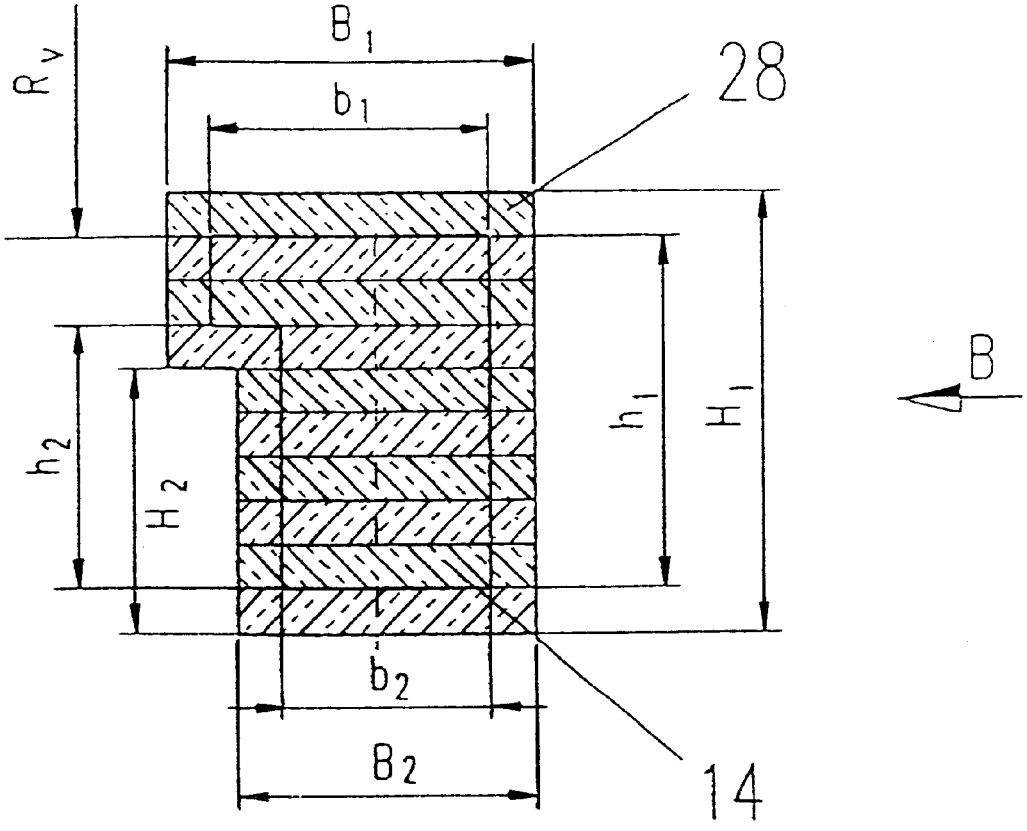
FIG. 4 is a section along the line A—A of FIG. 6 with a vertical cross-sectional view of the bonded wood package and the finished rail.

FIG. 4 shows the cross section of a wood package bonded (e.g. glued) together of ten individual layers, which may comprise planks/boards, laminated veneer wood, plywood or presspahn wood (particle board). The cross section of this wood package 28 corresponds with oversize exactly to the cross section of the finished rail 14, also shown in the drawing, i.e. the cross section of the oversized wood package 28 also comprises a main body and a projecting nose.

The dimensions of wood package 28 or of wooden rail 14 according to the design of the roller coaster are also shown.

Figure 5:
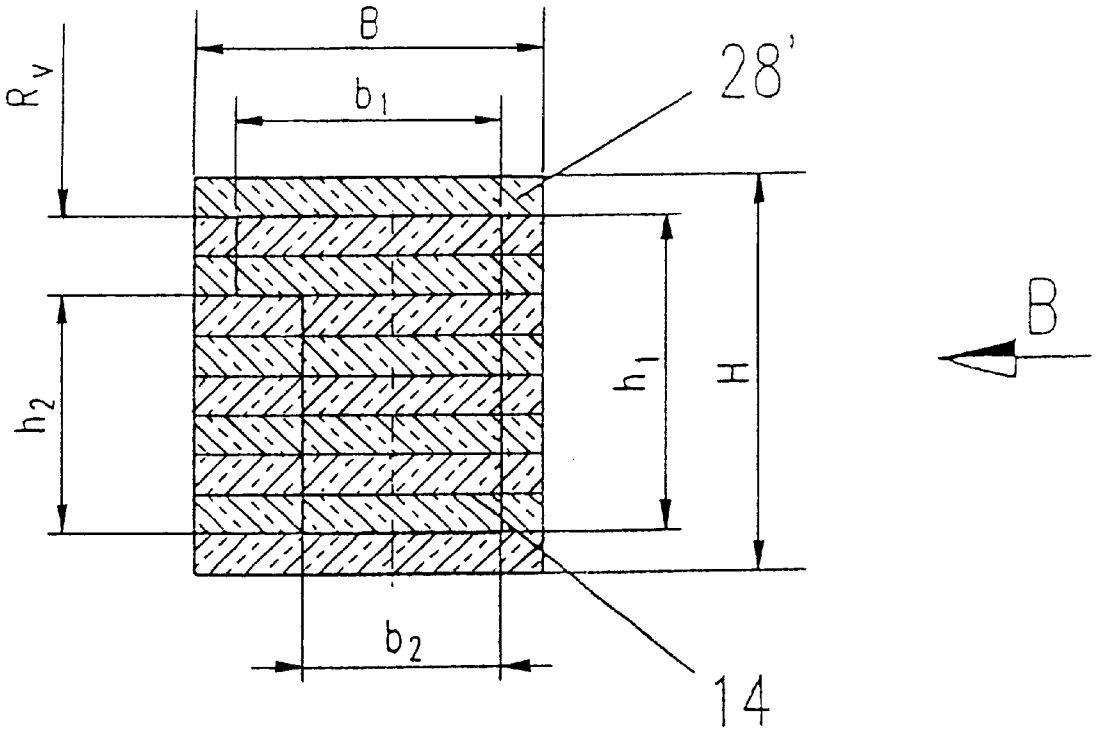
FIG. 5 shows a representation in accordance with FIG. 4 with another cross sectional form of the bonded wood package.

FIG. 5 shows an alternative to the wood package 28, namely a bonded wood package 28', which has a rectangular shape in cross section. The cross section of the finished wooden rail 14 has remained unchanged, and the oversize of the wood package 28' can also be seen.

The oversize of the bonded and hardened wood packages 28, 28' is now removed by milling out so that only the cross section of the finished wooden rail 14 remains.

The wood package 28' in accordance with FIG. 5 has the advantage of a simplified fabrication, as the ten individual layers have the same dimensions. The disadvantage of the wood package 28' is that a relatively large amount of wood has to be milled out.

Bonding the wood package 28 of FIG. 4 is somewhat more complicated, as one must work with wood layers of two different dimensions. However, there is less waste wood.

Figure 6:
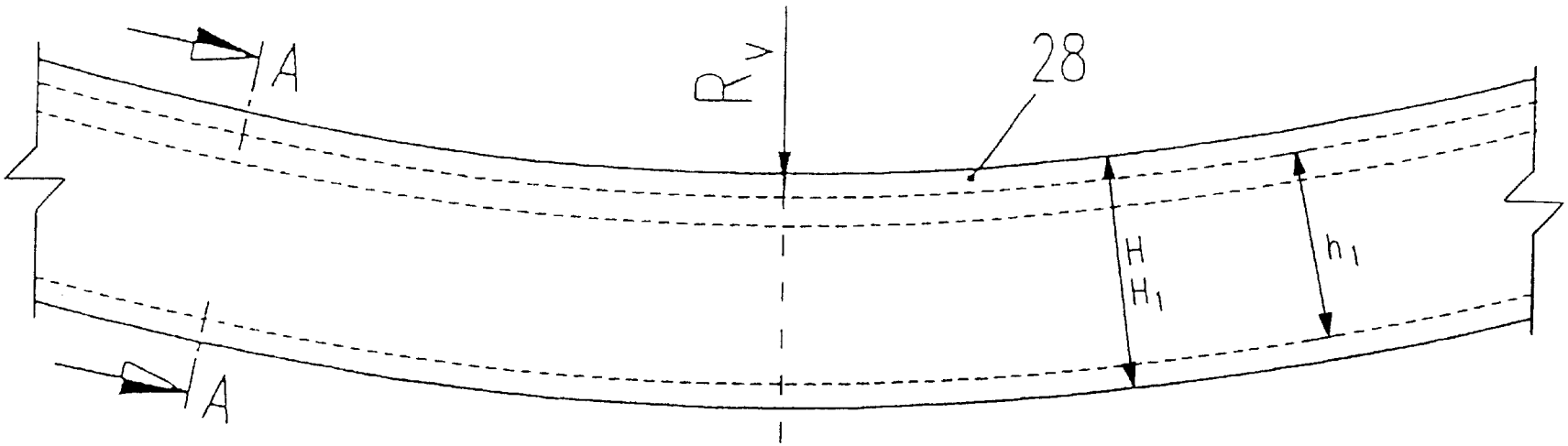
FIG. 6 shows a wood package and a wooden rail having a vertical radius $R_V$.

FIG. 6 shows a wooden rail 14 with a vertical radius $R_V$, i.e. the rail is curved in the vertical rail plane.

The oversize of the wood package 28, 28' with respect to the finished rail 14 is designed such that the radius $R_V$ vertical to the rail plane is taken into consideration in this oversize. This can be seen in FIGS. 4 and 5, which may also be interpreted as a section along the line A—A of FIG. 6. For this reason, the dimensions of the bonded wood package 28, 28', or of the finished wooden rail 14, is again included in FIG. 6.

As can be seen from FIG. 6, the curvature of the vertical radii, i.e. of the radius $R_V$ vertical to the rail plane, is taken into consideration for bonding so that a wood package 28 arises, which has a vertical radius $R_V$ in its upper surface. That is, when the layers of the wood package 28 are laid up for bonding, they are formed with the vertical radius. After the wood package 28 is hardened, an upper layer is milled out in accordance with this radius, so that the upper surface of the finished rail 14 has a corresponding curvature, i.e. a radius $R_V$ vertical to the rail plane.

Figure 8:
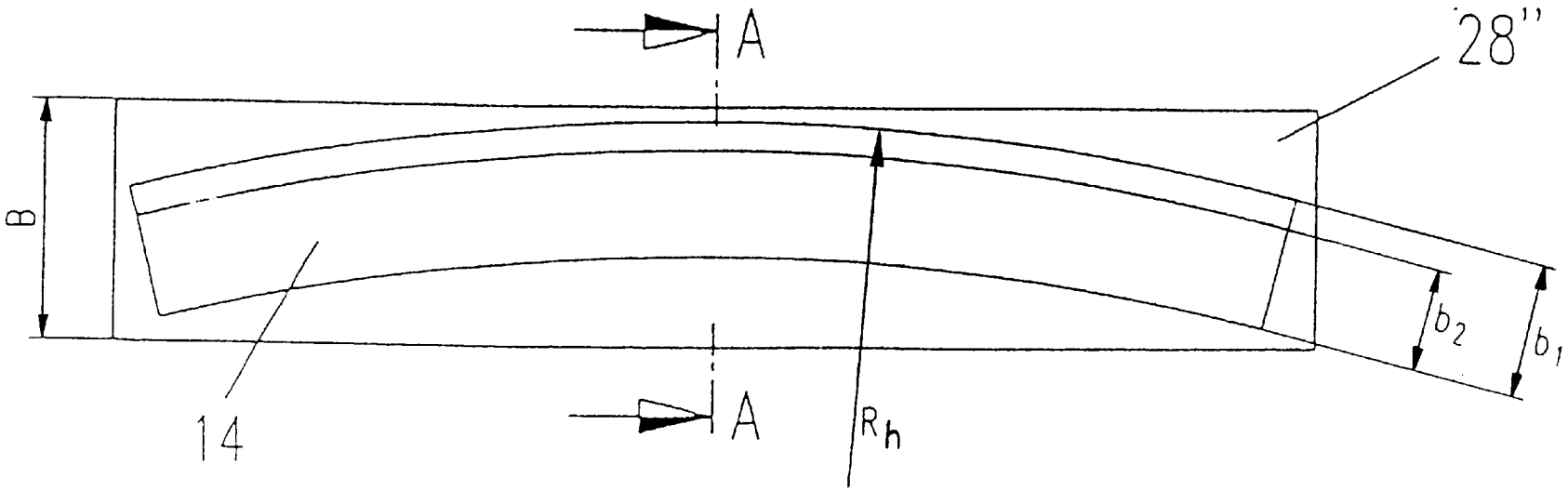
FIG. 8 is a plan view of a bonded wood package with a representation of a wooden rail having a horizontal radius $R_H$.

FIG. 8 is a plan view of a bonded/glued wood package 28" with a radius $R_H$, horizontal to the rail plane. With regard to the cross section of the finished rail, the oversize of this bonded wood package 28" is so designed that the horizontal radius $R_H$ is included in oversize in the rail plane in the wood package 28".

Figure 7:
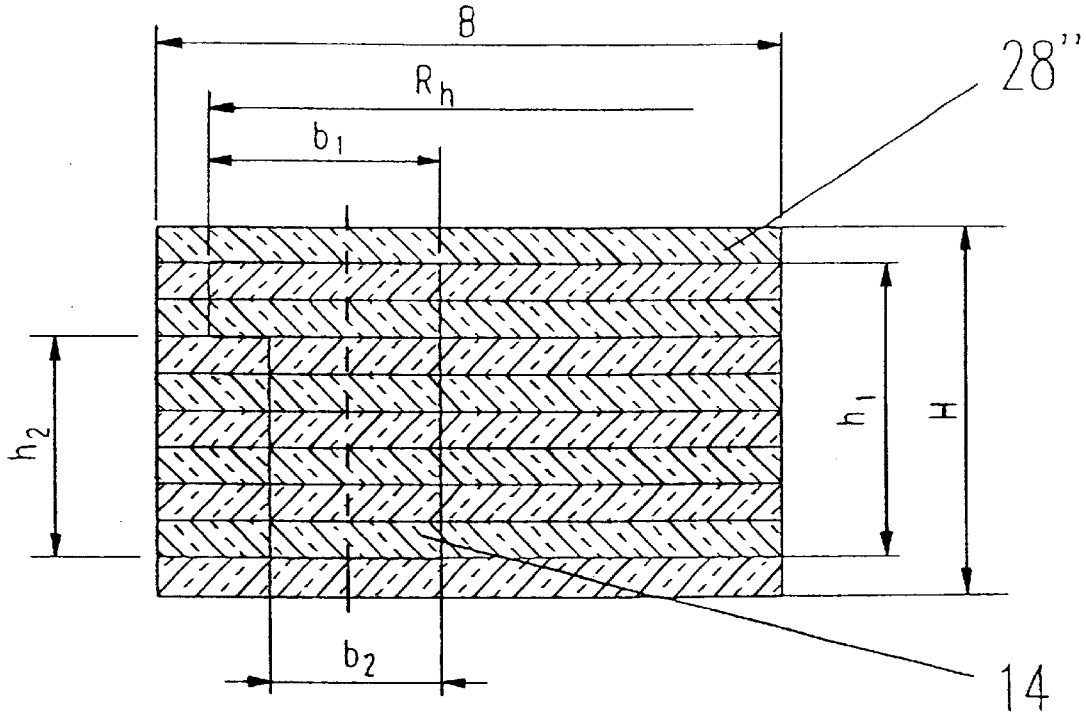
FIG. 7 is a section along line A—A of FIG. 8.

FIG. 7 is a section along line A—A of FIG. 8, which reveals the same.

Figure 9:
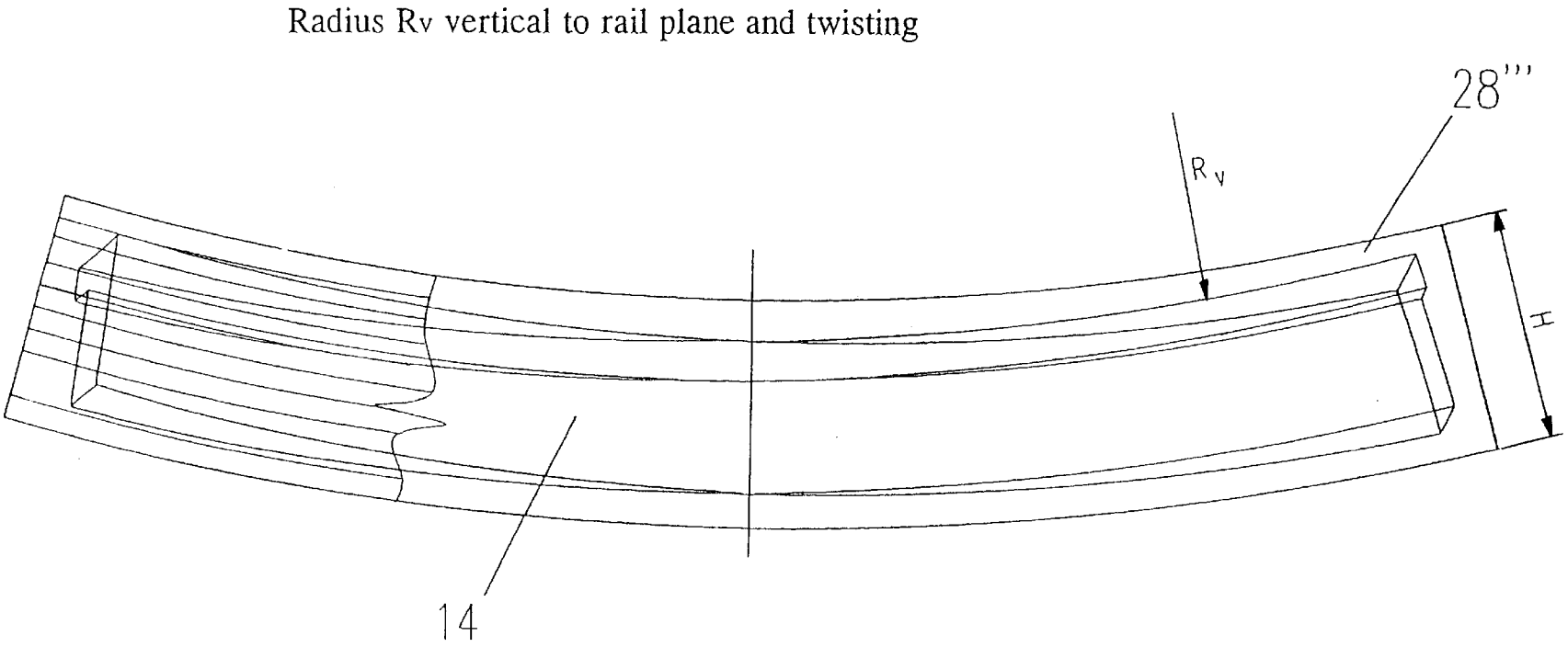
FIG. 9 shows a bonded wood package and a milled wooden rail having a radius $R_V$ perpendicular to the rail plane.
Figure 10:
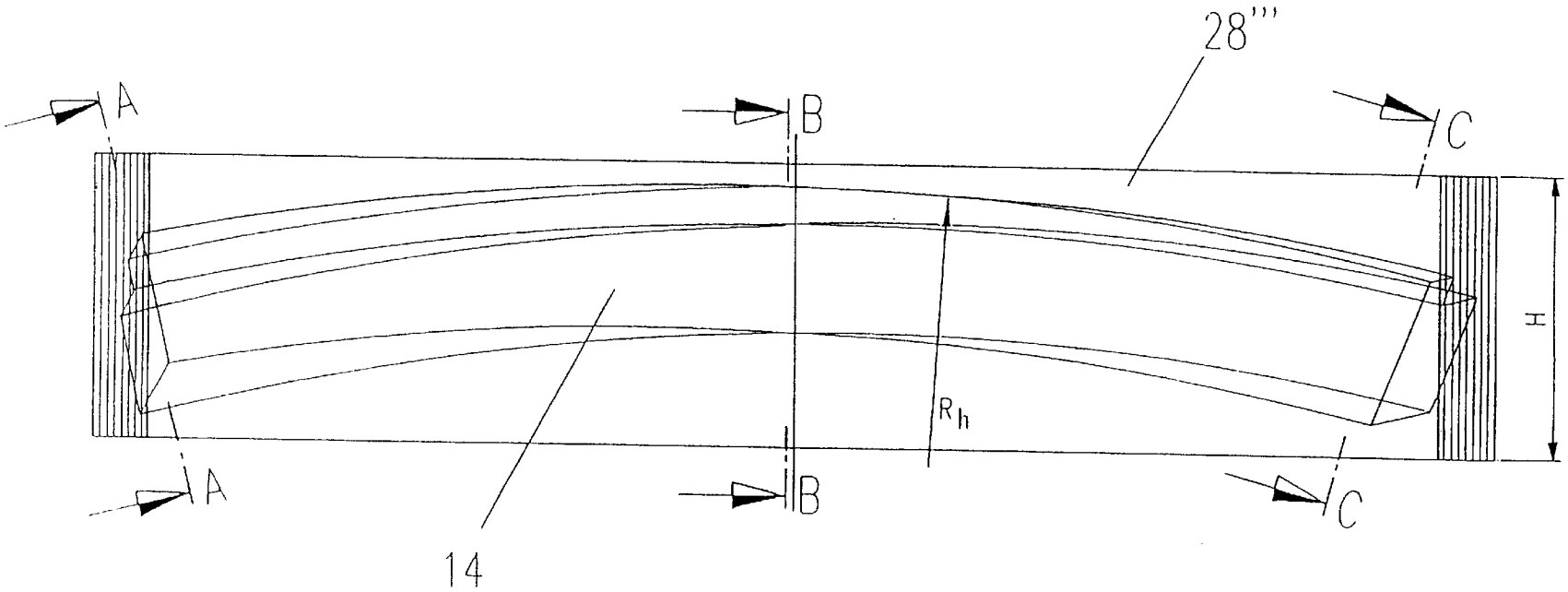
FIG. 10 is a plan view of a bonded wood package and a twisted wooden rail of radius $R_H$ horizontal to the rail plane.

FIGS. 9 and 10 are a view or a plan view of a bonded wood package, from which a wooden rail 14 is milled with a radius $R_V$, perpendicular to the rail plane, a radius $R_H$, horizontal to the rail plane, and with inherent twisting. In this connection, the curvature perpendicular to the rail plane is again taken into consideration for bonding, while the radius horizontal to the rail plane and the twisting in oversize of the wood package 28''' is included, as compared to the finished wooden rail 14.

Figure 11:
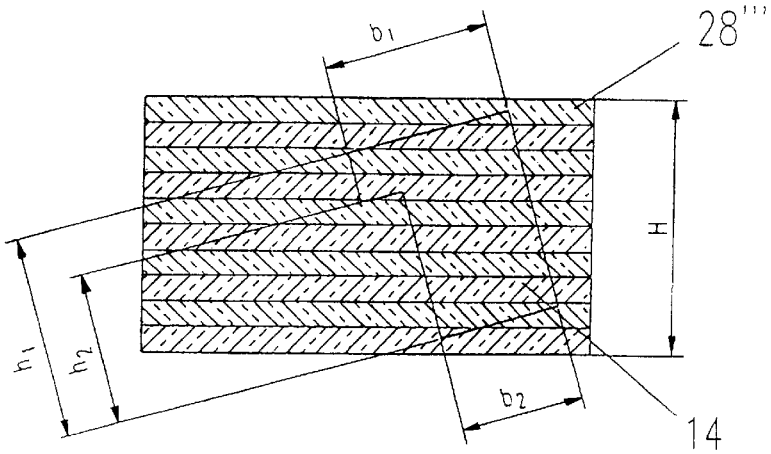
FIG. 11 are three sections of the plan view of FIG. 10, namely, above is a section along line A—A, in the middle is a section along line B—B, and at the bottom is a section along line C—C.
Figure 11:
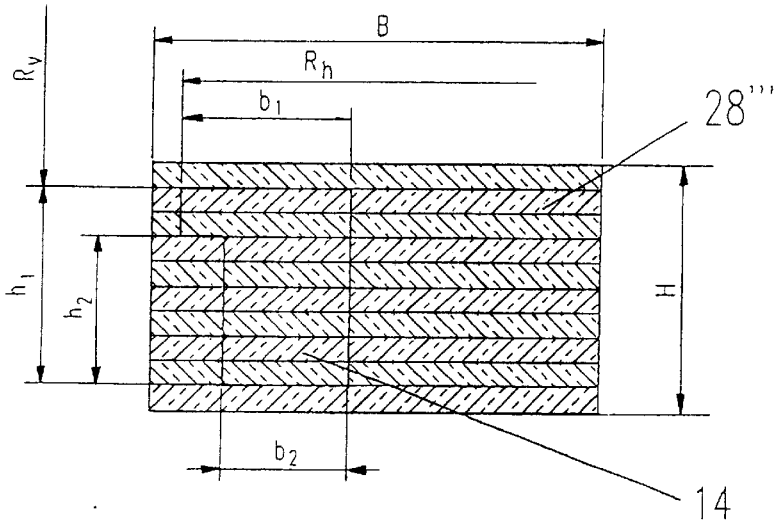
Figure 11:
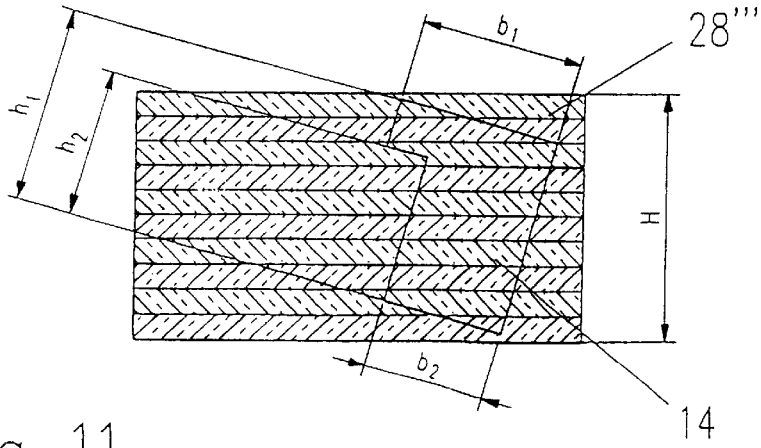

This can also be seen from FIG. 11, showing three sections through FIG. 10, namely, on top along line A—A, in the middle along line B—B, and at the bottom along line C—C. As can be seen, the different positions of the finished rail 14, resulting from the twisting, are included in the oversize of the bonded wood package 28'''.

The individual layers of planks/boards, laminated veneer wood, plywood or presspahn wood (particle board) may be treated with a wood preservative. Rails which are put under a lot of stress may have an uppermost layer of hardened material, especially a material hardened by silicification, or of hardwood.

The individual layers, generally at least eight layers, are bonded with each other using a standard wood bonding means to form a bonded wood package 28. The upper surface of the oversize bonded wood package is adapted to a rail curvature with vertical radii, perpendicular to the rail plane, whereas the horizontal radii of the rail can be found in the rail plane, and the twist of the rail is included within the boundaries of the oversized wood package 28 with regard to each individual rail 14.

Then, the bonded wood package 28 is milled to form the precise rail shape in accordance with the design of the ride, the exact machine form being worked out via given coordinates, including a possible spatial twisting of each rail.

If necessary, the rail 14, 14', milled out, may again be treated with a wood preservative.

The embodiments according to FIGS. 2 to 5, 7 and 9 to 11 have layers, bonded with each other, arranged parallel to the rail plane. Alternatively, the individual layers may also be arranged perpendicular to the rail plane or, in a mixed construction, partially perpendicular and partially parallel to the rail plane, for example each alternately, and then bonded with each other.

Figure 17:
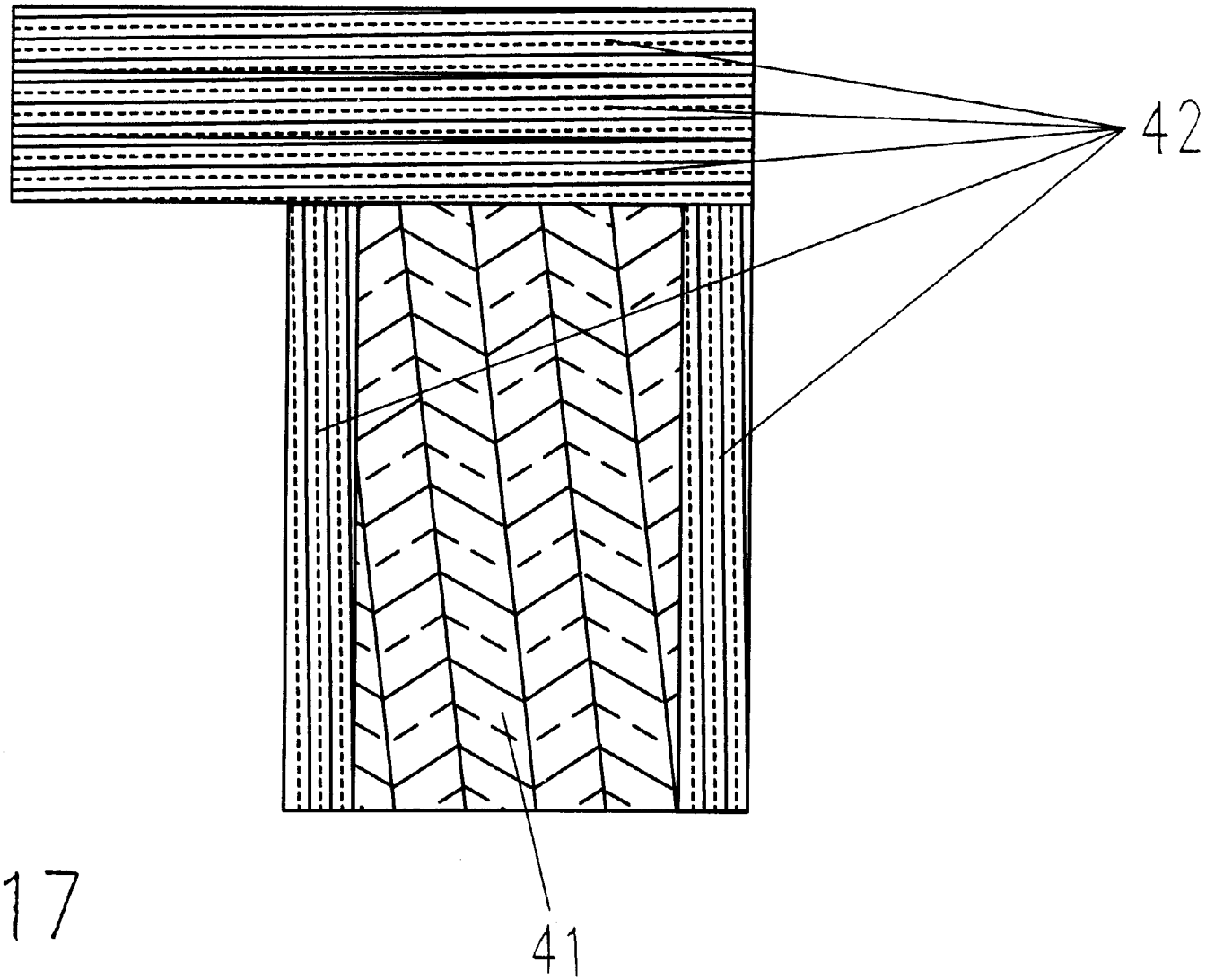
FIG. 17 shows a rail, e.g. according to FIG. 4, with a bonded and milled core.

Another variant is shown in FIG. 17, according to which, in line with the procedure described above, a core 41 is used consisting of layers bonded with each other in oversize and then precisely milled to the desired form, such layers being arranged perpendicular to the rail plane. The upper surface and the left and right side of this core 40 are provided with layers 42 consisting of individual planks/boards, laminated veneer wood, plywood or presspahn wood (particle board) bonded with each other and with the core 40. The embodiment according to FIG. 17 comprises three layers 42, arranged on the upper surface, and one layer 42 on the left and right side, respectively.

The material for these side or top layers 42 may be selected taking into consideration the characteristic features respectively required therefore.

Although this work can also be done at site, i.e. at the place where the roller coaster is to be erected, it is preferred to use prefabricated rail joints, namely the joints between two adjacent rail sections. This is shown in FIGS. 12 and 13.

Figure 12:
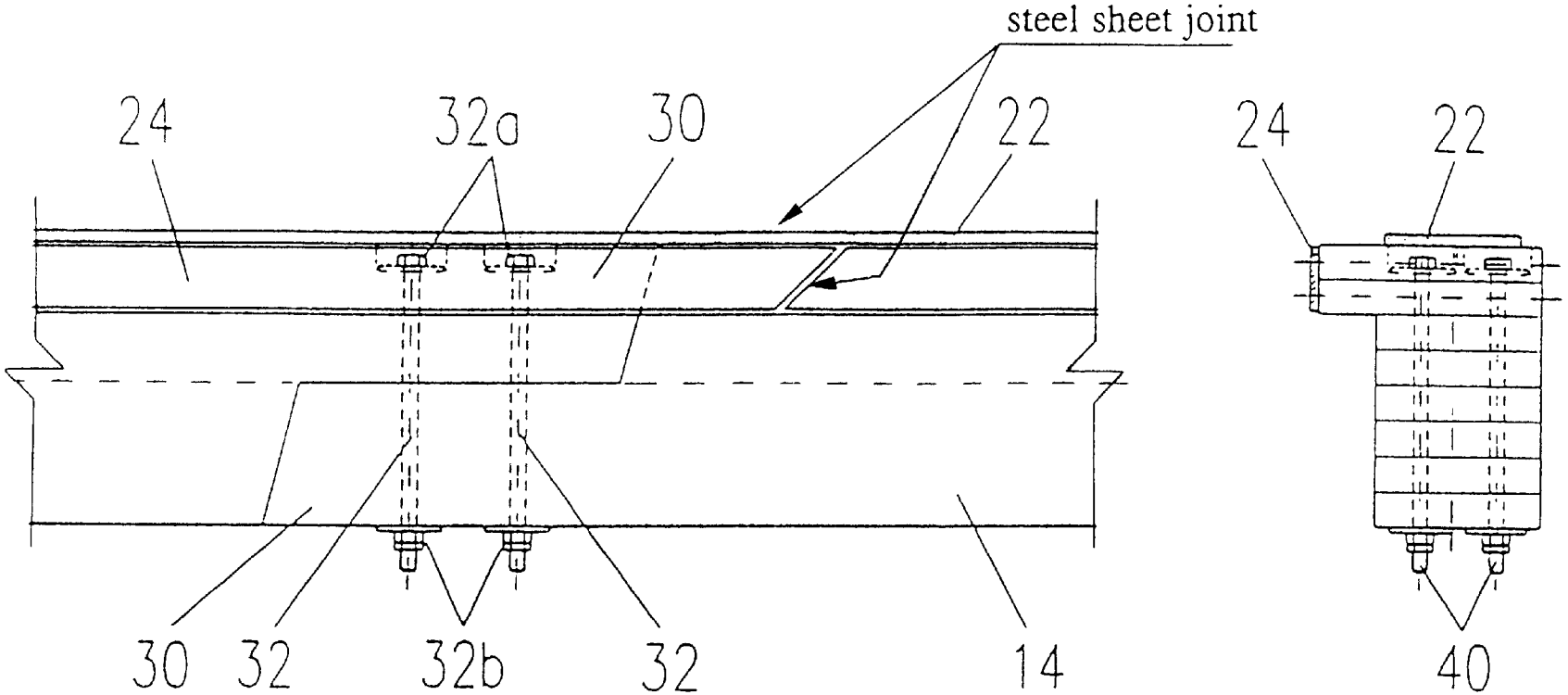
FIG. 12 is a side view of the joint area between two adjacent wooden rails.
Figure 13:
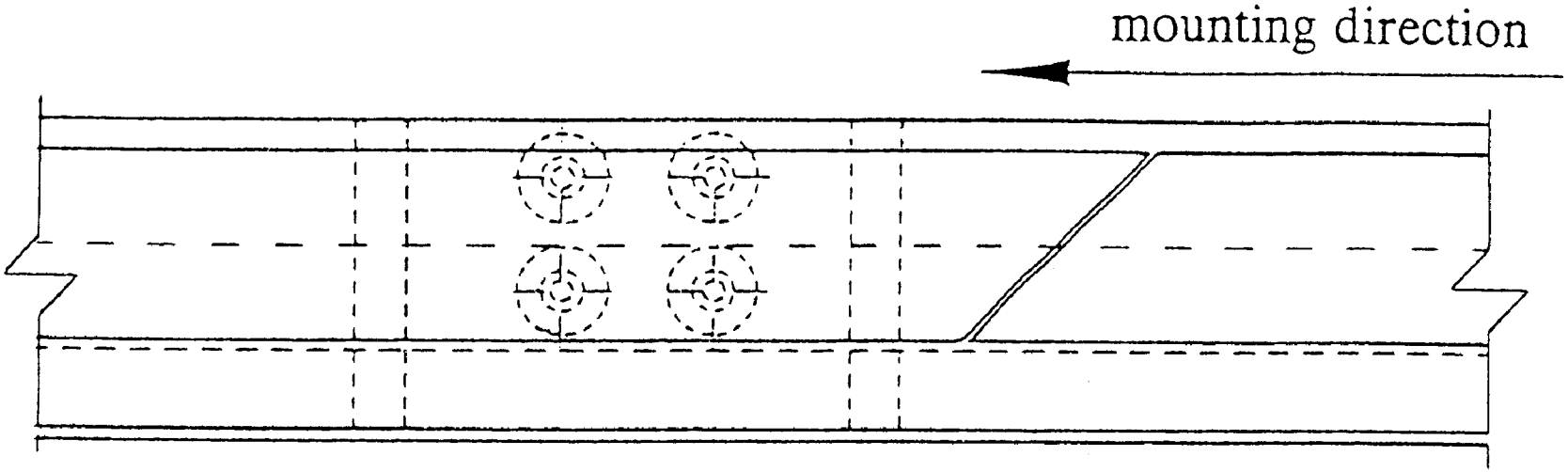
FIG. 13 is a plan view of the joint area according to FIG. 12.

It can be seen from FIG. 12 that the end portions of each rail 14 are milled such that each end is provided with a projecting tongue 30 of a thickness corresponding to about half the thickness of the rail. The front faces of each tongue 30 and the front faces of each rail 14 at the beginning of each tongue 30 are inclined with complementary angles so as to provide a form-fit engagement when the two tongues 30 are placed one above the other, as can be seen from FIG. 12.

The overlapping regions of both tongues 30 are provided with bores to allow the tongues 30, and thus the rails 14, to be connected with each other by screws 32 at this location.

Now, steel sheets 22, 24 are mounted on the rail, this preferably having already been done in the factory. The steel sheet joint slightly protrudes beyond the rail element joint so that, after two adjacent ends 30 of two rails 14 are joined, the rail element joint is covered by the steel sheet joint.

As can also be seen from FIG. 12, see also the representation on the right, recesses are milled under the steel sheet 22 to receive the heads 32*a* of the connecting screws 32 therein. According to this embodiment, screws 32 are positioned in the corresponding bores of the tongues 30 already in the factory so that the screw heads 32*a* can be subsequently covered by the steel sheet 22.

In this condition, the wooden rails 14 with inserted screws 32 and prepared joints, for both the wooden rail 14 as well as the steel sheets 22, 24, will then be transported to the place where the roller coaster is to be erected.

The joints of the rail elements may then be combined with each other by inserting screws 30 into the bores of the respective lower tongue 30 and fastening them by means of locking nuts 32*b*.

The plain joint represented in FIGS. 12 and 13 in the rail plane may also arranged 90° perpendicular to the rail plane.

Figure 14:
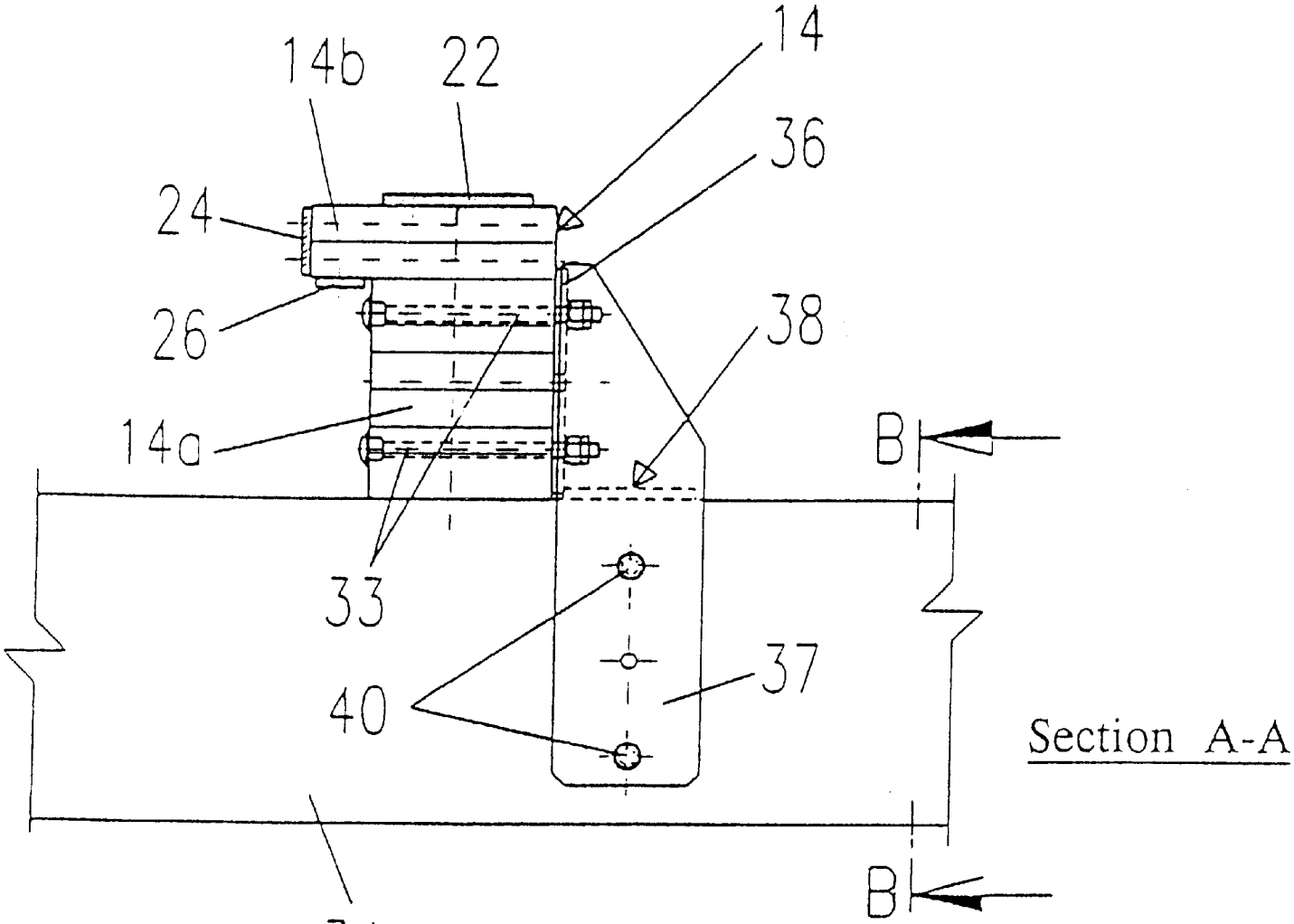
FIG. 14 is a section along line A—A of FIG. 15 showing how a single rail is mounted to a rail support fixed to the trestle.

In a last step, the individual rails are then mounted on a rail support 34, located at a vertical trestle (not shown) of the roller coaster skeleton, as can be seen in FIG. 14. In this case, the rail 14 rests with the lower surface of its main part 14*a* on the rail support 34 so that its nose 14*b* at its upper end is directed to the left in accordance with the representation in FIG. 14. Two screws 33 (carriage bolts) extend horizontally through the main part 14*a* of the rail 14 and have heads and nuts at their left ends. At the opposite end of rail 14, the screws 33 are secured by nuts to a plate 36, which forms the bottom of a U-shaped steel connection element 38. The two side walls 37 of the U-shaped connection element 38 project below the underside of rail 14 so that the rail support 34 is located between the two lower legs 37 of the connection element 38, where it is fastened by two further screws 40. The upper end of the two side faces 37 of the connection element 38 are inclined towards the rail 14.

Figure 15:
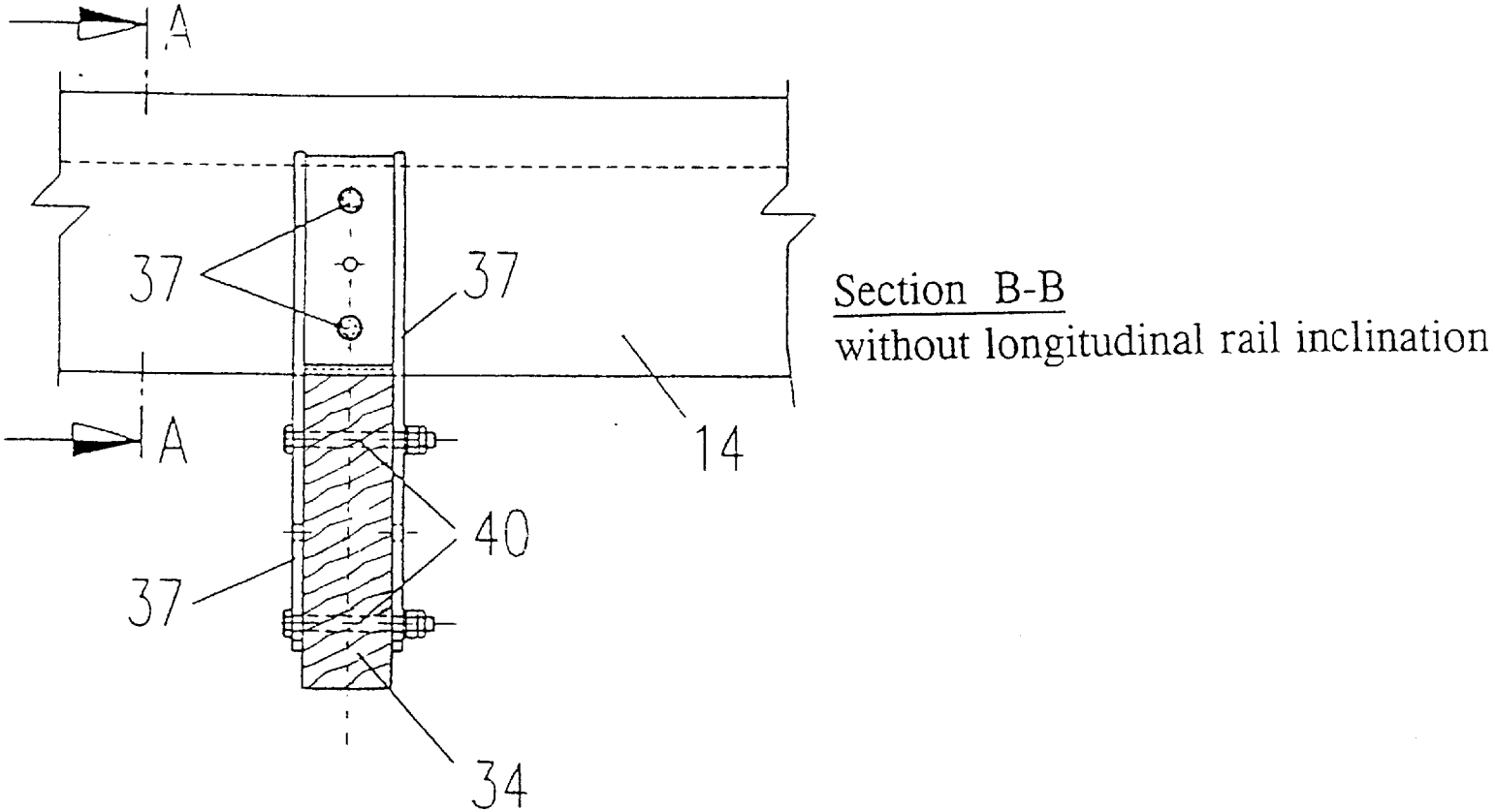
FIG. 15 is a section along line B—B of FIG. 14 for a rail without longitudinal inclination.
Figure 16:
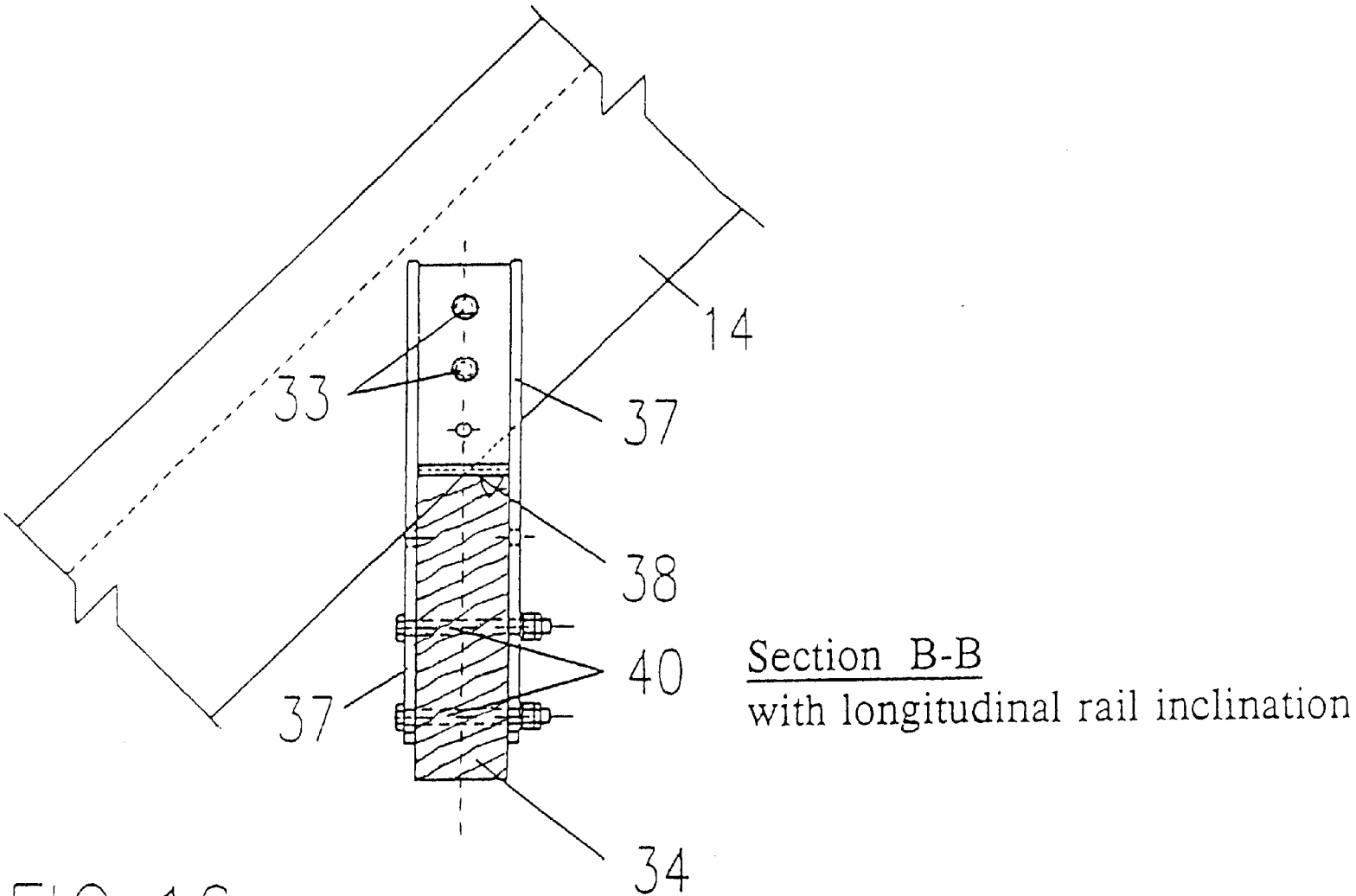
FIG. 16 shows a rail according to FIG. 15 with longitudinal inclination.

FIGS. 14 and 15 show an embodiment in which the rail 14 is mounted to the rail support 34 without longitudinal rail inclination. FIG. 16 shows such a mounting with longitudinal rail inclination.

What is claimed is:

1. A wooden rail for a ride, comprising a number of layers of individual wood members, bonded to each other and milled to a precise rail form in accordance with a roller coaster design, and a connection element mounted to the precise rail form for mounting the rail to a rail support and the connection element includes a U-shaped portion for receiving the rail support.

2. The wooden rail of claim 1, wherein the individual layers are arranged in one or more planes, at least one of which is parallel to the rail plane.

3. A wooden rail for a ride, comprising a number of layers of individual wood members, bonded with glue to each other to form an oversized package, from which is milled a precise rail form in accordance with a roller coaster design, and wherein the precise rail form includes a plurality of layers bonded together to form a core, and one or more further layers bonded to each of a top and a side of the core.

4. The wooden rail of claim 3, wherein the individual layers are treated with a wood preservative either before or after bonding.

5. The wooden rail of claim 3, wherein the bonded and milled layers are treated with a wood preservative.

6. The wooden rail of claim 3, wherein at least an uppermost layer, which forms a bearing surface of the rail, consists of hardwood.

7. The wooden rail of claim 3, wherein at least an uppermost layer, which forms a bearing surface of the rail, consists of a hardened material.

8. The wooden rail of claim 3, further comprising steel sheets mounted to the rail in the precise rail form, and the precise rail form having one or more joints being provided in at least one end of the precise rail form.

9. A method for mounting a wooden rail on a rail support, fixed to a trestle of the ride, comprising providing a wooden rail as set forth in claim 3, and securing the rail to said rail support.

10. The wooden rail of claim 3, wherein the wood members are selected from the group including planks, boards, laminated wood veneer, and particle board wood.

11. The wooden rail of claim 3, wherein the individual layers are arranged in one or more planes, at least one of which is perpendicular to the rail plane.

* * * * *